US005230406A

United States Patent [19]

Poon

[11] Patent Number: 5,230,406

[45] Date of Patent: Jul. 27, 1993

[54] SAFETY BRAKE ARRANGEMENT FOR ELEVATORS

[76] Inventor: Otto L. Poon, 17th Floor, Java Centre, 124-134 Java Road, North Point, Hong Kong

[21] Appl. No.: 832,009

[22] Filed: Feb. 6, 1992

[30] Foreign Application Priority Data

Feb. 6, 1991 [GB] United Kingdom ..... 9102504

[51] Int. Cl.[5] ..... B66B 5/16

[52] U.S. Cl. ..... 187/88; 187/89

[58] Field of Search ..... 187/89, 88, 90; 188/188, 189

[56] References Cited

U.S. PATENT DOCUMENTS 5,096,020 3/1992 Korhonen ..... 187/88

FOREIGN PATENT DOCUMENTS 236904 11/1925 United Kingdom ..... 187/88

*Primary Examiner*—D. Glenn Dayoan
*Assistant Examiner*—Kenneth Noland
*Attorney, Agent, or Firm*—Wolf, Greenfield & Sacks

[57] ABSTRACT

A safety brake arrangement for an elevator includes a brake for preventing relative movement of the elevator car and the elevator car guide rail, having a double wedge shape capable of preventing overspeeding in both the upward and downward directions and an activation mechanism responsive to overspeeding in both directions.

6 Claims, 10 Drawing Sheets

SAFETY BRAKE ARRANGEMENT FOR ELEVATORS

The present invention relates to automatic safety brake arrangements for elevators which comprise an elevator car moving on elevator guide rails up and down an elevator shaft.

One well known automatic safety brake arrangement consists of a safety brake mounted on the car and operable to engage the guide rail to prevent movement of the car relative to the guide rail, and a safety brake automatic operating mechanism comprising an endless rope or belt mounted so as to extend along the elevator shaft, a linkage mounted on the elevator car and connected to the endless rope so that as the elevator car moves up and down the endless rope is also caused to move up and down, and a governor driven in rotation by the movement of the endless rope, the linkage also being operatively connected to the safety brake, whereby overspeeding of the elevator car causes corresponding overspeeding of the endless rope and of the governor, causing the governor to operate thereby stopping the endless rope and tripping the linkage to operate the safety brake. The safety brake is wedge shaped in a direction which prevents overspeeding in the downward direction and the linkage is designed to trip the safety brake when the elevator car descends too quickly.

The well known arrangement described above suffers from the disadvantage that only overspeeding in the downward direction is prevented, while overspeeding in the upward direction is not prevented. Ascending too quickly may cause personal injuries which are different to and often more severe than the personal injuries caused from decending too quickly. For example ascending too quickly may cause neck damage.

An object of the present invention is to provide a safety brake arrangement which prevents overspeeding in either direction.

The invention provides an elevator of the type described including a safety brake having a double wedge shape to prevent overspeeding in the upward and downward directions and a linkage moveable between a neutral state in which the linkage pulls the endless rope, a first tripped state in which the linkage operates the safety brake to prevent overspeeding in the downward direction, and a second tripped state in which the linkage operates to prevent overspeeding in the upward direction.

An existing safety brake arrangement of the well known type described above may be easily converted to a safety brake arrangement in accordance with the invention by substituting the existing safety brake and linkage by a safety brake and linkage in accordance with the invention.

The invention will now be described more particularly with reference to the accompanying drawings which show, by way of example only, a first arrangement of elevator including one particular construction of brake according to the invention, and which also show further constructions of brake according to the invention, and a second arrangement of elevator.

Figure 12A:
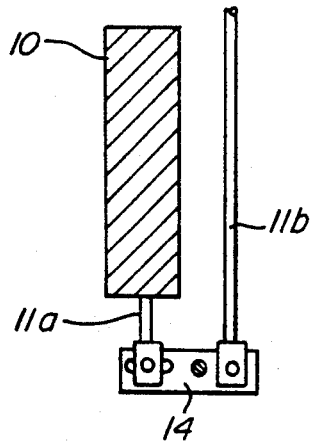
Figure 13:
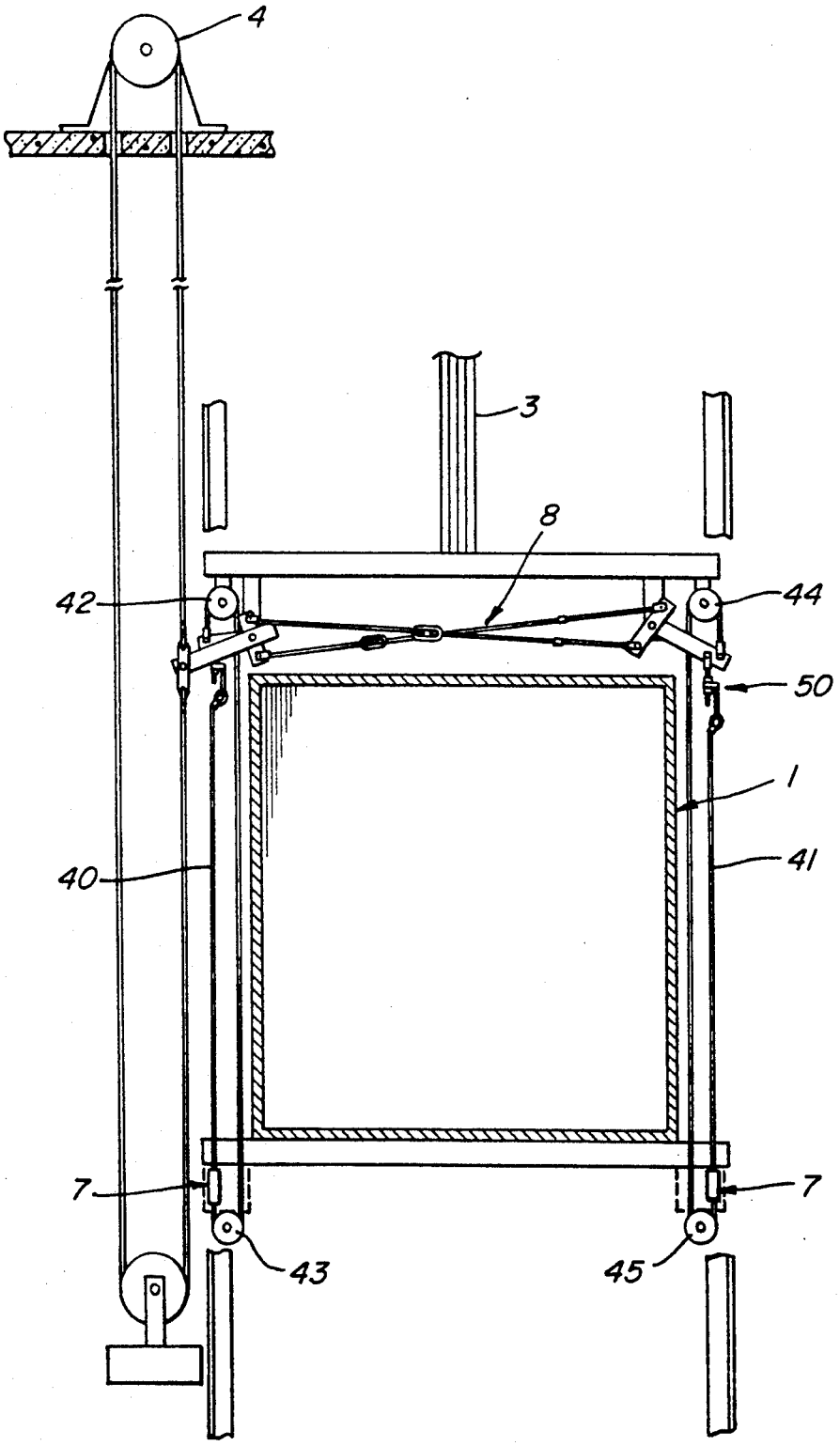
Figure 14:
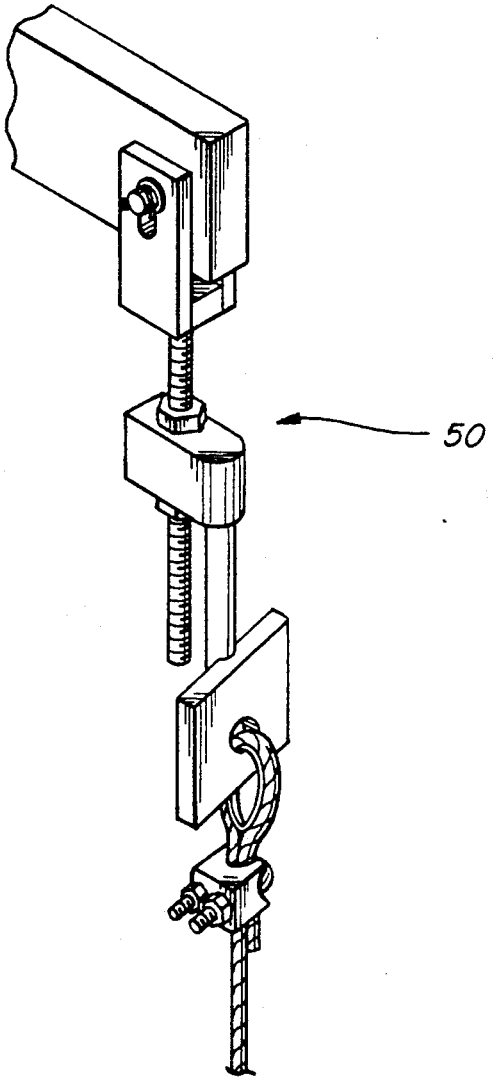

FIG. 12*a* shows on a larger scale the construction of a particular mechanism which forms part of the elevator, and FIGS. 12*b*, 12*c*, 12*d* and 12*e* show alternative constructions;

FIG. 13 is a view similar to FIG. 1 to 4 showing the second arrangement of elevator safety system; and FIG. 14 is a perspective view on a much larger scale of a detail of the second arrangement.

Referring now to the drawings, the elevator comprises essentially an elevator car 1, guide rails 2 for guiding the car in its upward and downward motion, and a rope 3 for raising and lowering the elevator car.

The elevator safety mechanism comprises a governor 4, an endless governor rope 5, a tension adjuster 6 for the governor rope, safety brakes 7 mounted on the elevator car 1 for stopping the elevator car in the event of overspeeding, and a mechanical linkage 8 mounted on the elevator car 1 and connecting the governor rope 5 to the safety brakes 7.

Figure 1:
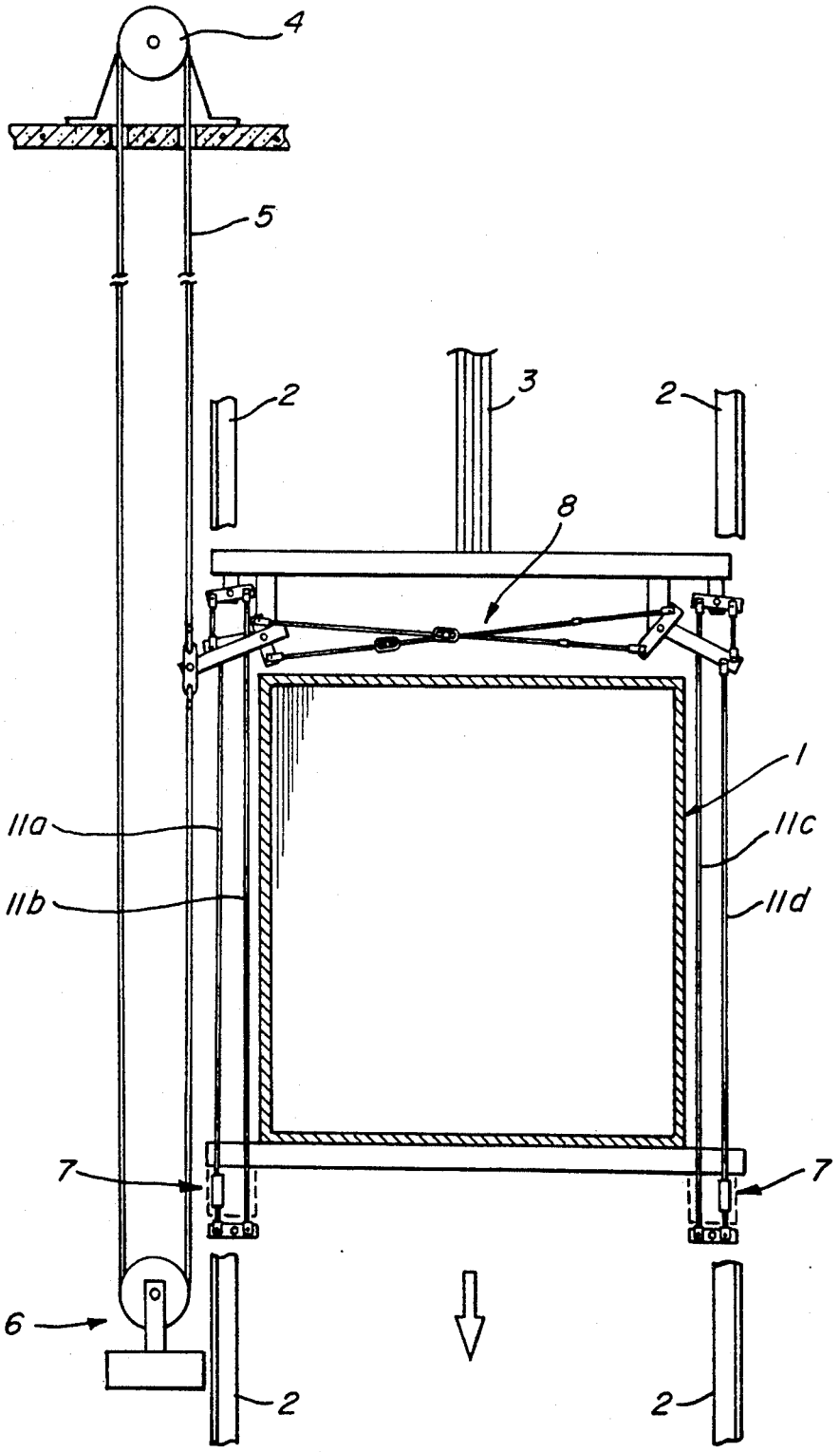
FIG. 1 is an elevation of the first arrangement of elevator, with the elevator car shown travelling downwardly at normal speed.

Referring to FIG. 1 the elevator car 1 is shown moving downwardly at normal speed, and pulling the governor rope 5 downwardly at the same speed, thereby causing the governor to rotate clockwise at this speed.

Figure 2:
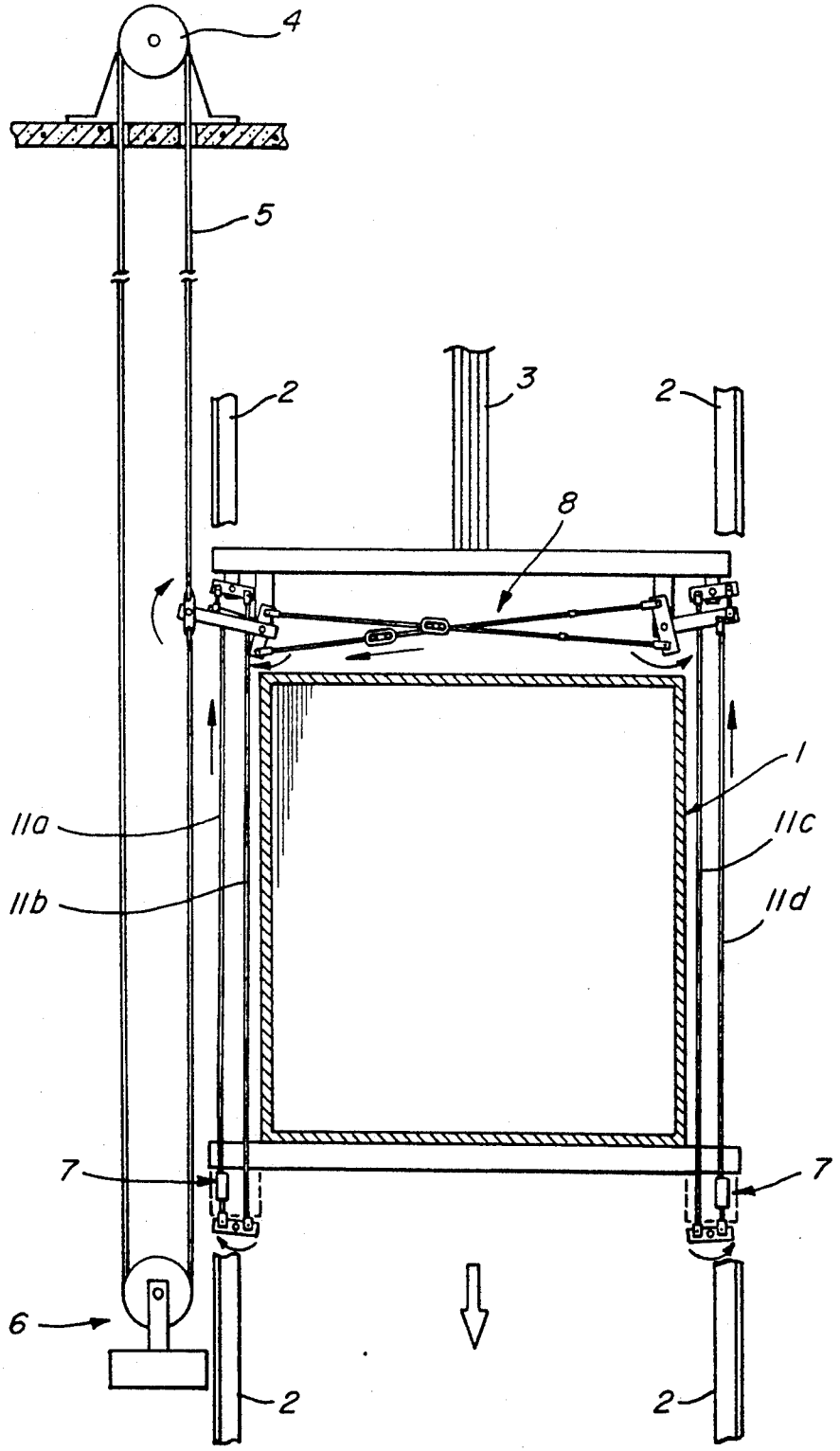
FIG. 2 is a similar view, but showing the elevator immediately after the safety brake has been activated to prevent downward overspeeding of the elevator car.

Referring to FIG. 2, as the elevator car 1 starts to overspeed downwardly the governor rope 5 and governor 4 start to overspeed, thereby tripping the governor 4 which prevents further overspeeding of the governor rope 5, which therefore moves more slowly than the elevator car 1, thereby tripping the linkage 8 and activating the safety brakes 7.

Figure 3:
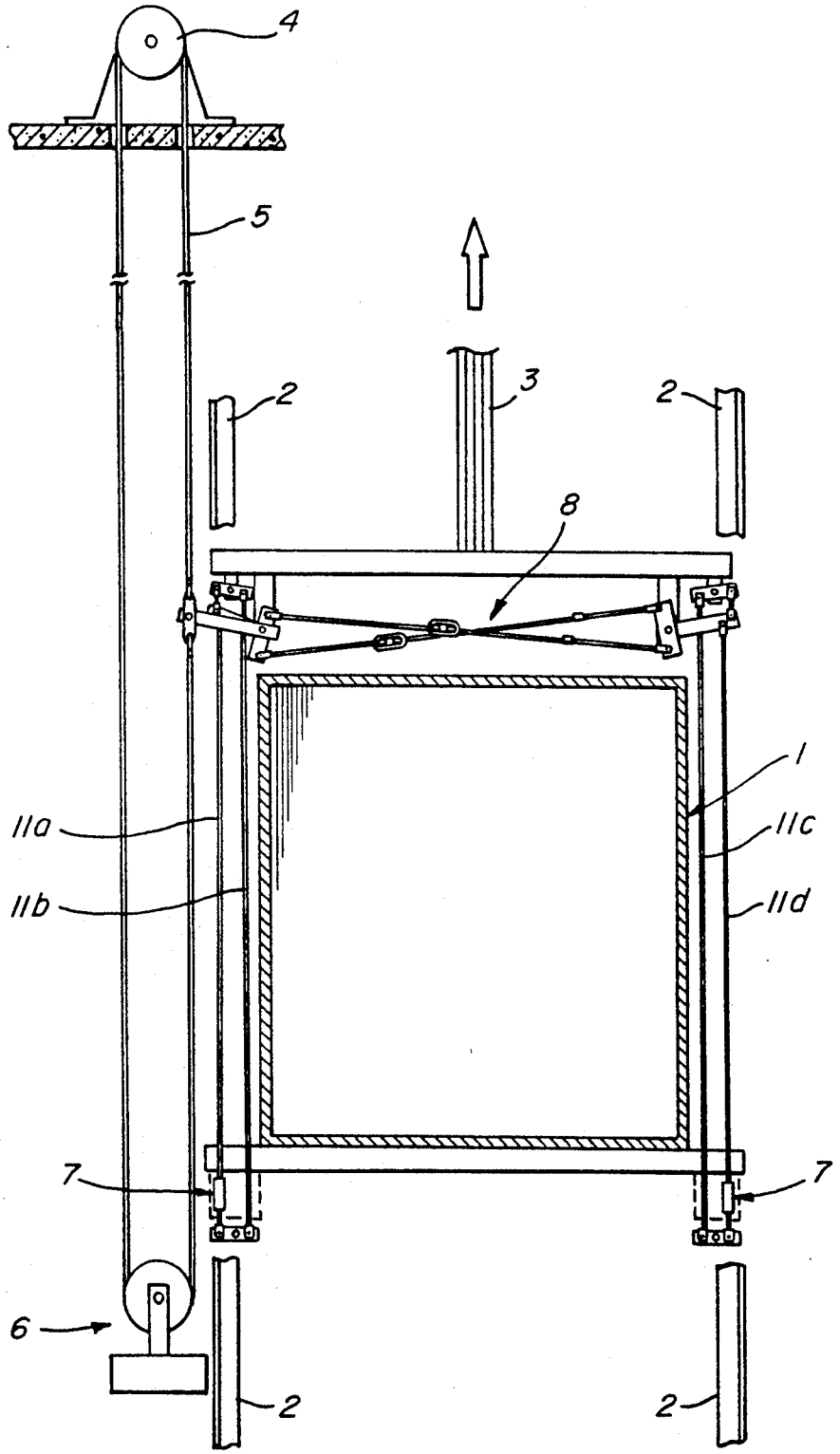
FIG. 3 is a similar view but showing the elevator car travelling upwardly at normal speed.
Figure 4:
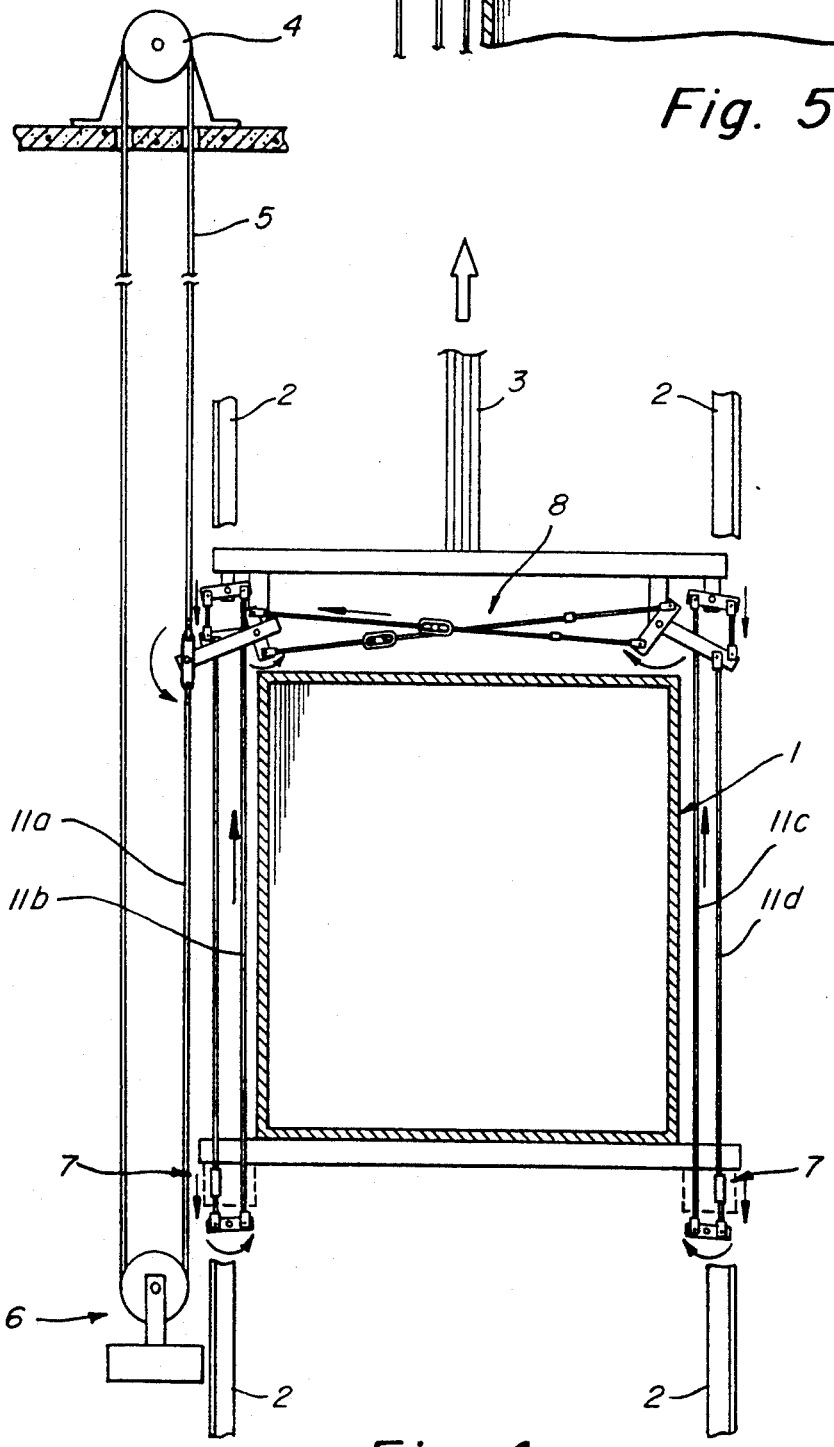
FIG. 4 is a similar view, but showing the elevator immediately after the safety brake has been activated to prevent upward overspeeding of the elevator car.

Referring to FIGS. 3 and 4, these are similar to FIGS. 1 and 2, except that they illustrate normal speed and overspeed in the upward direction.

Figure 5:
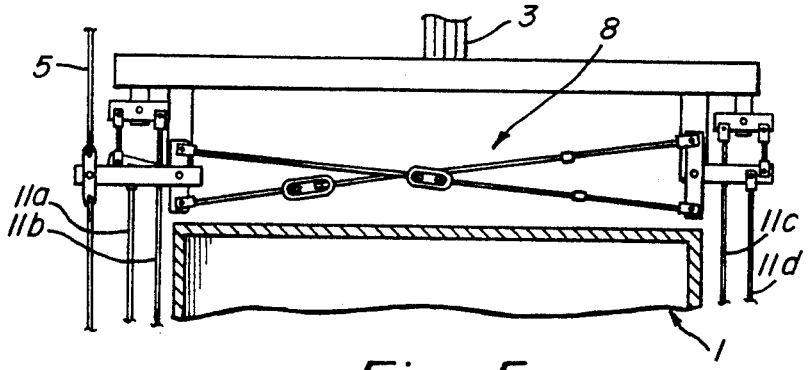
FIG. 5 shows on a larger scale a fragmentary view of a detail of the elevator with the elevator car at rest.

FIG. 5 shows the rest position of the linkage 8 when the elevator is not in use.

Figure 6:
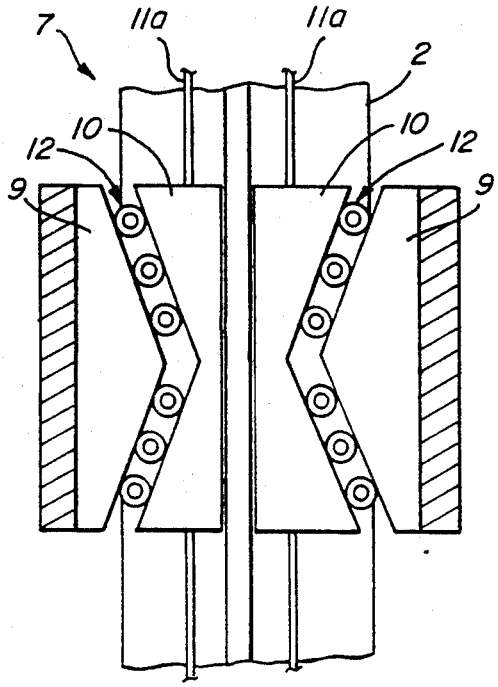
FIG. 6 is an elevation of one preferred construction of safety brake according to the invention.

Referring to FIG. 6, one construction of safety brake will now be described. The safety brake comprises essentially two parts, a wedge 9 and a wedge guide 10.

The wedge guide 10 is mounted in a fixed position relative to the elevator car 1. The wedge 9 is mounted so as to be movable vertically upwardly or downwardly relative to the elevator car 1, and is connected to the linkage 8 by means of pull rods 11*a*, 11*b* in the case of the left hand brake and 11*c*, 11*d* in the case of the right hand brake.

During normal operation of the elevator, that is to say when the elevator car 1 is travelling upwardly or downwardly at normal speed, the wedges 9 and wedge guides 10 are in register with one another as shown in the drawings. However, as shown in FIG. 2, if the elevator car 1 overspeeds downwardly thereby operating the linkage 8, then this causes the pull rods 11*a* and 11*d* to move the wedges 9 vertically upwardly relative to the wedge guides 10. A set of rollers 12 are provided between the wedge guides 10 and the wedges 9 to permit this relative movement. As the wedges 9 move up relative to the wedge guides 10, the wedges 9 also move horizontally outwardly as a result of the complementary shape of the wedges 9 and wedge guides 10, and engage the elevator car guide rails 2, so as to prevent further movement of the elevator car 1. Similarly, as shown in FIG. 4, if the elevator car 1 overspeeds downwardly this causes the pull rods 11*b* and 11*c* to move upwardly and wedges 9 to move downwardly and horizontally outwardly.

Figure 7:
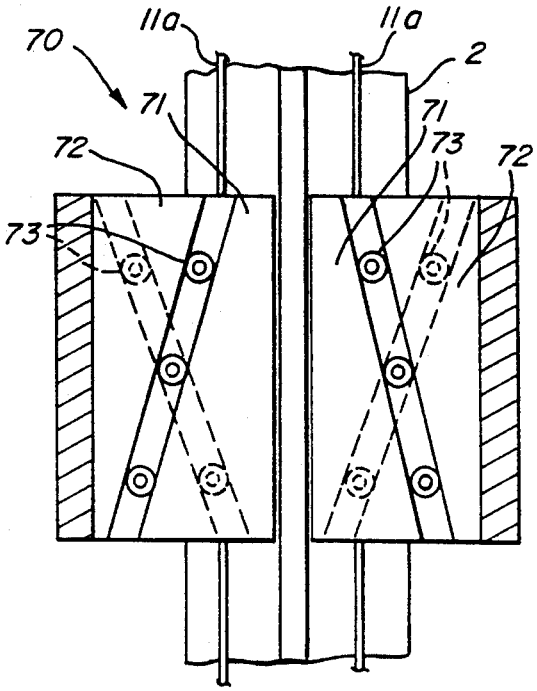
FIGS. 7, 8 and 9 are views similar to FIG. 6 of alternative constructions of safety brake according to the invention.
Figure 8:
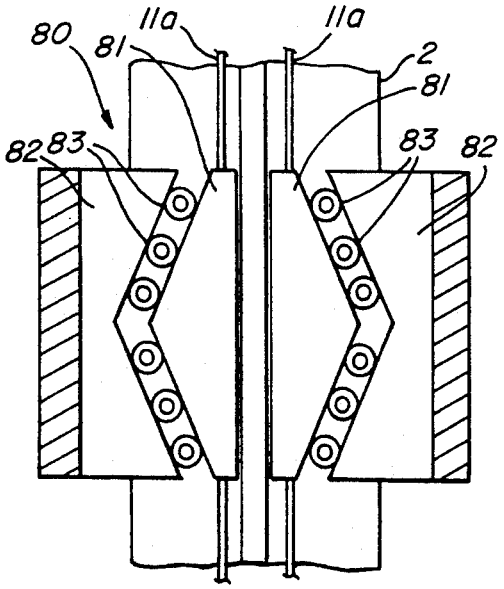
Figure 9:
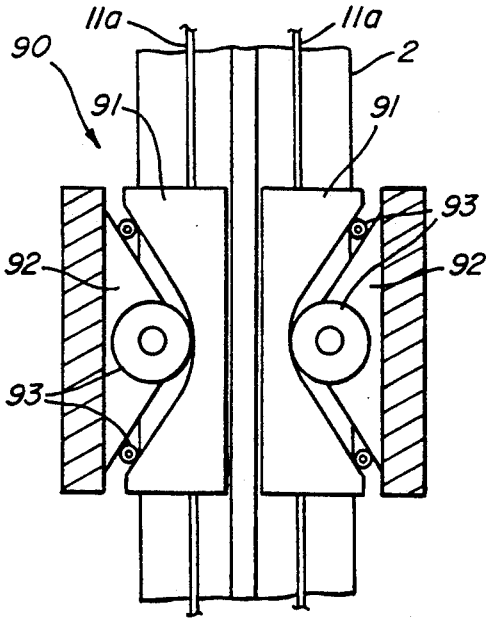

FIGS. 7, 8 and 9 show alternative constructions of brake 70, 80, 90 respectively, in each case consisting of a fixed wedge guide 71, 81, 91, a movable wedge 72, 82, 92, and a set of rollers 73, 83, 93.

Figure 10:
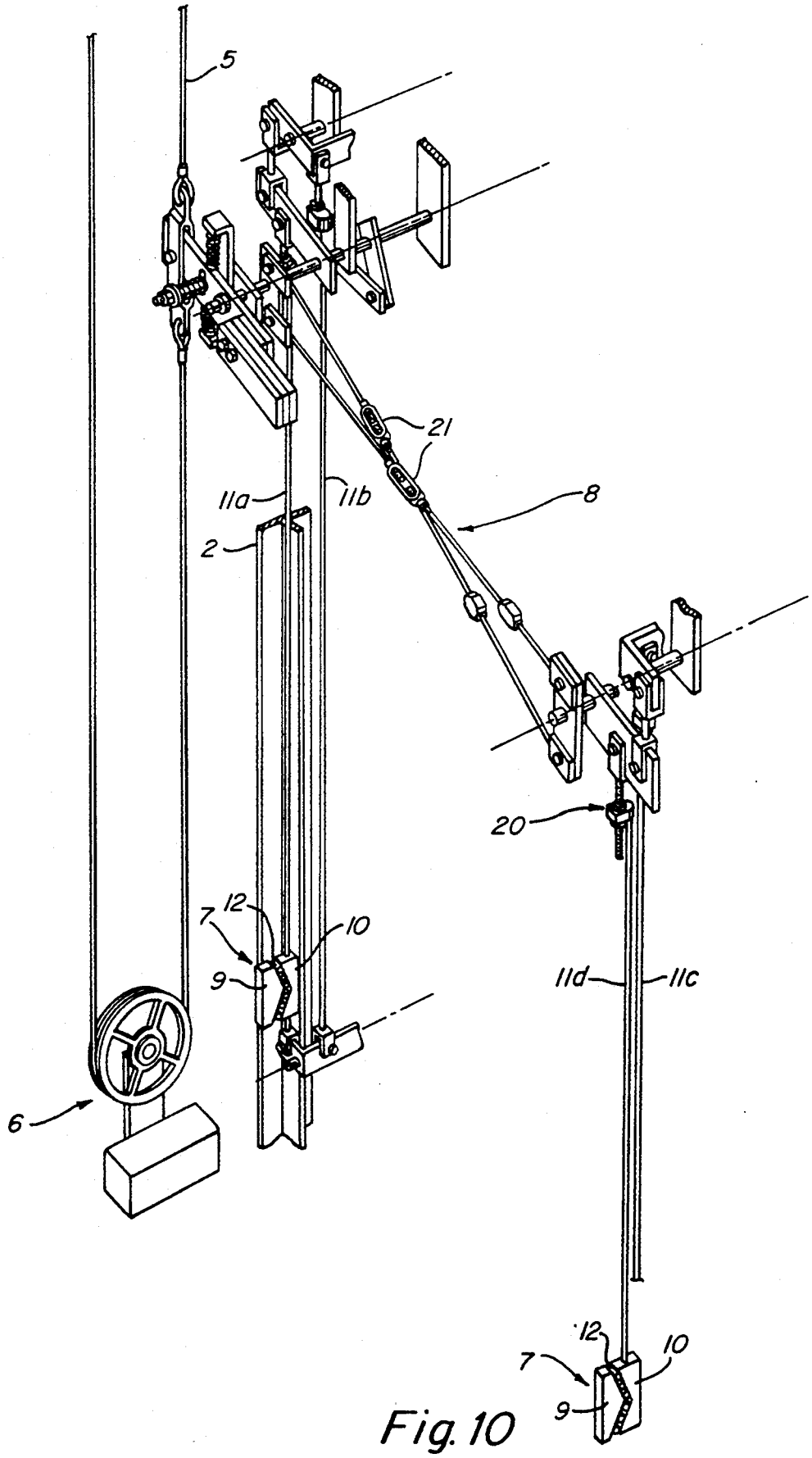
FIG. 10 is a perspective view of the use of safety brakes in accordance with FIG. 6, illustrating the brake activation mechanism of the elevator shown in FIGS. 1 to 5.

Referring now to FIG. 10, certain features of the system may be seen more clearly. These include the push-pull rod adjustment mechanism 20 and the linkage adjustment turn buckles 21.

Figure 11:
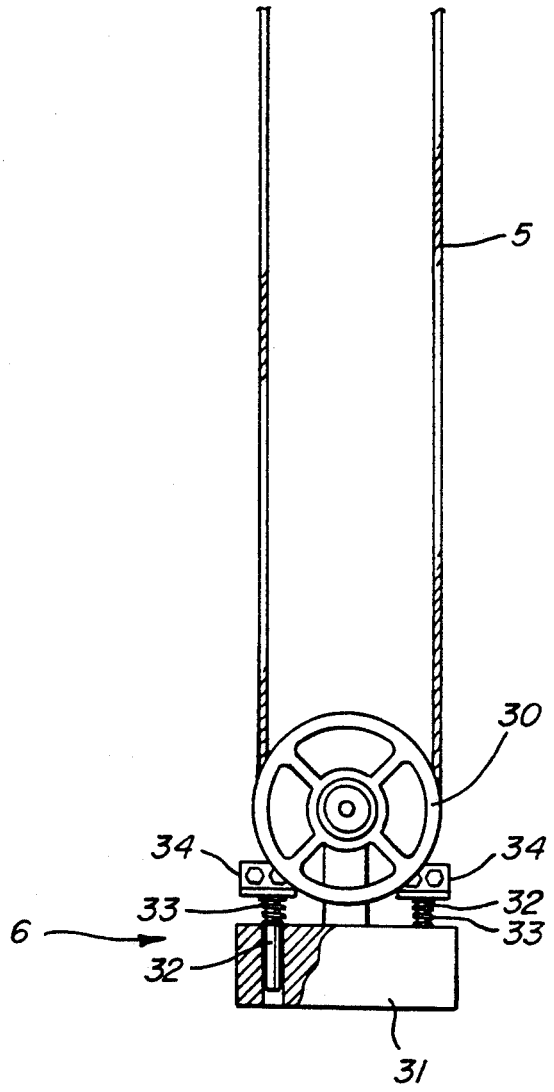
FIG. 11 is an elevation of a detail of the brake activation system of FIG. 10.

Referring now to FIG. 11, the tension adjuster 6 for the governor rope 5 comprises a tensioning pulley 30, a weight 31 attached to the tensioning pulley to maintain tension in the pulley, the weight being vertically movable upwardly or downwardly along guide pins 32, and compression springs 33 on the guide pins between fixed limit brackets 34 and the weight, for biasing the weight against upward movement.

Referring to FIG. 12*a*, there is shown on a larger scale wedge 9 by means of a pivoting link 14. A similar arrangement is provided for push rod 11*c*. Rods 11*a* and 11*d* are connected directly to the wedges.

Figure 12B:
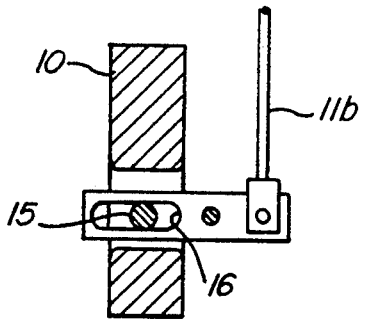
Figure 12C:
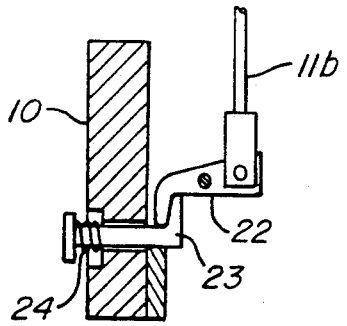
Figure 12D:
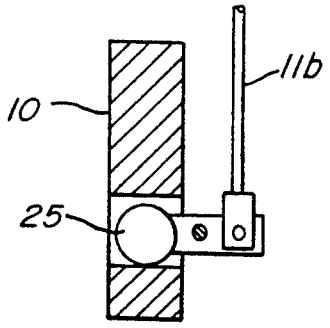
Figure 12E:
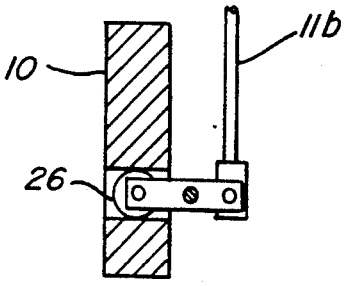

FIGS. 12*b*, 12*c*, 12*d* and 12*e* show alternative mechanisms. FIG. 12*b* shows a guide pin 15 on the wedge 9 floating in oblong hole 16. FIG. 12*c* shows a pivoting lever 22 and a plunger 23 biassed by compression spring 24. FIG. 12*d* shows a cam 25. FIG. 12*e* shows a roller 26.

Referring to FIG. 13 there is shown an alternative arrangement in which the push rods 11*a*, 11*b*, 11*c* and 11*d* are replaced by ropes 40, 41 on pulleys 42, 43, 44, 45. This arrangement is simpler and more compact but readjustment may be required after each operation to compensate for possible rope elongation.

Referring to FIG. 14, there is shown on a larger scale a particular mechanism illustrated in FIG. 13, namely the adjustment mechanism generally designated 50 for tensioning the ropes 40 and 41.

I claim:

1. A safety brake arrangement for an elevator which comprises an elevator car moving on an elevator guide rail up and down an elevator shaft, comprising a safety brake mounted on the car and operable to engage the guide rail to prevent movement of the car relative to the guide rail, and a safety brake automatic operating mechanism comprising an endless rope or belt mounted so as to extend along the elevator shaft, a linkage mounted on the elevator car and connected to the endless rope so that as the elevator car moves up and down the endless rope is also caused to move up and down, and a governor driven in rotation by the movement of the endless rope, the linkage also being operatively connected to the safety brake, whereby overspeeding of the elevator car causes corresponding overspeeding of the endless rope and of the governor, causing the governor to operate thereby stopping the endless rope and tripping the linkage to operate the safety brake, characterized by the provision of a safety brake including a pair of double wedge members disposed respectively on opposite sides of the guide rail and wherein each double wedge member includes a pair of wedge surfaces, one surfaces shaped for preventing overspeeding in the upward direction and the other surface shaped for preventing speeding in the downward direction, and a linkage moveable between a neutral state in which the linkage pulls the endless rope, a first tripped state in which the linkage operates the safety brake to prevent overspeeding in the downward direction, and a second tripped state in which the linkage operates to prevent overspeeding in the upward direction.

2. A safety brake arrangement according to claim 1 in which the mechanical linkage comprises ropes for activating the safety brake.

3. A safety brake arrangement according to claim 1 wherein the similarly shaped wedge surfaces on both sides of the guide rail, are activated simultaneously.

4. A safety brake arrangement according to claim 3 wherein each double wedge member includes a wedge having an extension which comprises two linear wedge surfaces which meet at an apex, and a wedge guide constructed and arranged so as to mate with the wedge extension, and wherein a set of rollers are provided between the wedge and wedge guides to permit movement of the wedge relative to the wedge guide.

5. A safety brake arrangement according to claim 3 wherein each double wedge member includes a wedge having an extension which comprises tow linear wedge surfaces which meet at an arc, and a wedge guide constructed and arranged so a to mate with the wedge extension, and wherein a set of rollers are provided between the wedge and wedge guides to permit movement of the wedge relative to the wedge guide.

6. A safety brake arrangement for an elevator which comprises an elevator car moving on an elevator guide rail up and down an elevator shaft, comprising a safety brake mounted on the car and operable to engage the guide rail to prevent movement of the car relative to the guide rail, and a safety brake automatic operating mechanism comprising an endless rope or belt mounted so as to extend along the elevator shaft, a linkage mounted on the elevator car and connected to the endless rope so that as the elevator car moves up and down the endless rope is also caused to move up and down, and a governor driven in rotation by the movement of the endless rope, the linkage also being operatively connected to the safety brake, whereby overspeeding of the elevator car causes corresponding overspeeding of the endless rope and of the governor, causing the governor to operate thereby stopping the endless rope and tripping the linkage to operate the safety brake, characterized by the provision of a safety brake having a double wedge shape on both sides of the guide rail with the double wedges being activated simultaneously to prevent overspeeding in the upward and downward directions and a linkage moveable between a neutral state in which the linkage pulls the endless rope, a first tripped state in which the linkage operates the safety brake to prevent overspeeding in the downward direction, and a second tripped state in which the linkage operates to prevent overspeeding in the upward direction, and wherein the mechanical linkage comprises push-pull rods.

* * * * *